United States Patent [19]

Whelan et al.

[11] 4,165,966

[45] Aug. 28, 1979

[54] DIRECT FLAME DRYING APPARATUS (RM-30C)

[75] Inventors: Edward J. Whelan, Hasbrouck Heights; William L. Douma, West Paterson, both of N.J.

[73] Assignee: Sun Chemical Corporation, New York, N.Y.

[21] Appl. No.: 819,354

[22] Filed: Jul. 27, 1977

Related U.S. Application Data

[63] Continuation-in-part of Ser. No. 658,902, Feb. 18, 1976, Pat. No. 4,052,152.

[51] Int. Cl.[2] ..... F27B 9/00; F26B 25/00

[52] U.S. Cl. ..... 432/121; 34/105; 432/230

[58] Field of Search ..... 432/121, 122, 124, 230; 34/105

[56] References Cited

U.S. PATENT DOCUMENTS

| | | | |
|---|---|---|---|
| 2,232,638 | 2/1941 | Schwalbe | 432/121 |
| 2,592,236 | 4/1952 | Bloom | 432/124 |
| 3,701,880 | 10/1972 | Rively | 65/120 |

*Primary Examiner*—John J. Camby
*Attorney, Agent, or Firm*—Cynthia Berlow

[57] ABSTRACT

A system for decorating cylindrical cans each having one open end including a curing section which receives the decorated cans with the decorations uncured. In the curing section the cans move through a preheat chamber where can temperature is elevated. The heated cans then move through a drying chamber where flames from gas and air fed burner heads impinge directly on the exterior of the can for curing of the decorations. Thereafter the cans pass through a cooling chamber and then exit from the curing section.

The preheat chamber is heated by the burners in the heating chamber. These burners are disposed so that the flame jets are directed downstream at an angle of approximately 13° with respect to lines normal to the path of travel for the cans. The burners are arranged in two parallel arrays disposed one above the other. As the cans travel between these arrays flame impingement on the cans is interrupted. Also provided are insulated tunnels within the heating chamber with these tunnels being arranged so that the gas burners are disposed therein.

9 Claims, 6 Drawing Figures

DIRECT FLAME DRYING APPARATUS (RM-30C)

This application is a continuation-in-part of our copending U.S. patent application Ser. No. 658,902, filed Feb. 18, 1976, now U.S. Pat. No. 4,052,152, for a Direct Flame Drying Apparatus For Cylindrical Containers.

This invention relates to the drying of decorated cylindrical objects such as two-piece metal cans, and more specifically relates to a compact energy efficient curing section for drying the can decoration material consisting of thermally dryable inks, varnishes and coatings, by utilizing a gas flame to impinge directly on the decorated can surface.

In the manufacture of a two-piece metal can for containing beverages and the like, the can body is formed and, before it is filled and the top put in place, the can is decorated, as by first placing a base coat on the can and printing a label on the can, and then placing an overvarnish layer on the can. Apparatus for performing these decorating operations are well known. One high speed device which decorates cans at rates in excess of 800 cans per minute is shown in U.S. Pat. No. 3,766,851 issued Oct. 23, 1973 to E. Sirvet et al., for a Continuous Can Printer and Handling Apparatus. This apparatus has a transfer mechanism for transferring the decorated cans to a pin-chain conveyor which conveys the cans to a suitable drying oven.

It is conventional to term apparatus for printing on cans, and for applying overvarnish on cans, as "can decorators" and it is conventional to term apparatus for coating cans as "can coaters." For convenience, the term "can decorator" used herein shall be intended to apply equally to apparatus for individually or collectively printing, coating or varnishing cans. The term "decorating medium" used herein is to refer to any ink, varnish or coating which is applied by the can decorator apparatus.

Presently used drying ovens for curing conventional inks and coatings consist of large, hot air, convection type ovens. When the inks and coatings used for the decoration are ultraviolet curable materials, the curing oven will contain ultraviolet lamps disposed along the path of movement of the decorated cans. A typical ultraviolet curing oven for curing decorated cans is shown in U.S. Pat. No. 3,840,999 issued Oct. 15, 1974 to E. J. Whelan and Apparatus For Radiation-Curing Of Coating On Multi-Sided Object.

The conventional hot air oven takes about 60 to 90 seconds or more to cure a decorated can. Consequently, the oven requires a large volume so that the rapidly moving can remains in the oven for the necessary curing time. Thus, even when the can path is festooned within the oven, the oven requires a large floor space and volume. The flame drying system has been found to cure a decorated can in about three seconds or less. Consequently, the drying stage requires only a small fraction of the area and volume required for the hot air oven.

The use of flame drying is more efficient than the hot air oven, and gas consumption is reduced as compared with the conventional hot air oven. Moreover, the direct flame impingement process causes the volatile substances driven off during the drying process to be at least partially combusted, thus reducing or completely eliminating the need for afterburning devices to meet current pollution standards.

The system of the present invention is advantageous over present ultraviolet curing systems since the invention allows the use of conventional heat set or thermally cured inks and coatings, as opposed to special ultraviolet curable inks and coatings which are more expensive and not as readily available as conventional heat setting inks.

A curing section constructed in accordance with the instant invention includes a preheat chamber wherein can temperature is raised before the cans enter the drying chamber wherein flame jets impinge directly upon the outside of each can. It has been found that by preheating the cans time and/or temperature factors within the heating section are less critical than in the absence of preheating, thereby lessening the likelihood of damage due to overheating.

System efficiency is maintained by utilizing heat overflow from the heating chamber for heating of the preheat chamber. Efficiency in the heating chamber is improved by placing the flame jets within insulated tunnels through which the cans move. Drying efficiency is also improved by utilizing flame drying in separate zones spaced from one another and interrupting flame drying as cans pass from one zone to the next. These flame drying zones are positioned one above the other rather than end to end for more efficient spaced utilization. This also reduces external surface areas available for heat radiation so that heat losses are reduced.

Drying efficiency is improved still further by positioning the gas burners so that the flame jets are not perpendicular to the path of can travel are directed downstream at a slight angle, in the neighborhood of 13°, with respect to a line normal to the path for can travel.

Accordingly, a primary object of the instant invention is to provide a more efficient flame dryer for curing decorations on cylindrical cans.

Another object is to provide a dryer of this type having a novel burner configuration.

Still another object is to provide dryer means of this type wherein flame impingement on the cans takes place as the cans move through insulated tunnels disposed within a heating chamber.

A further object is to provide a curing section of this type having means to preheat the cans before direct flame drying takes place.

These objects as well as other objects of this invention shall become readily apparent after reading the following description of the accompanying drawings in which.

Figure 1:
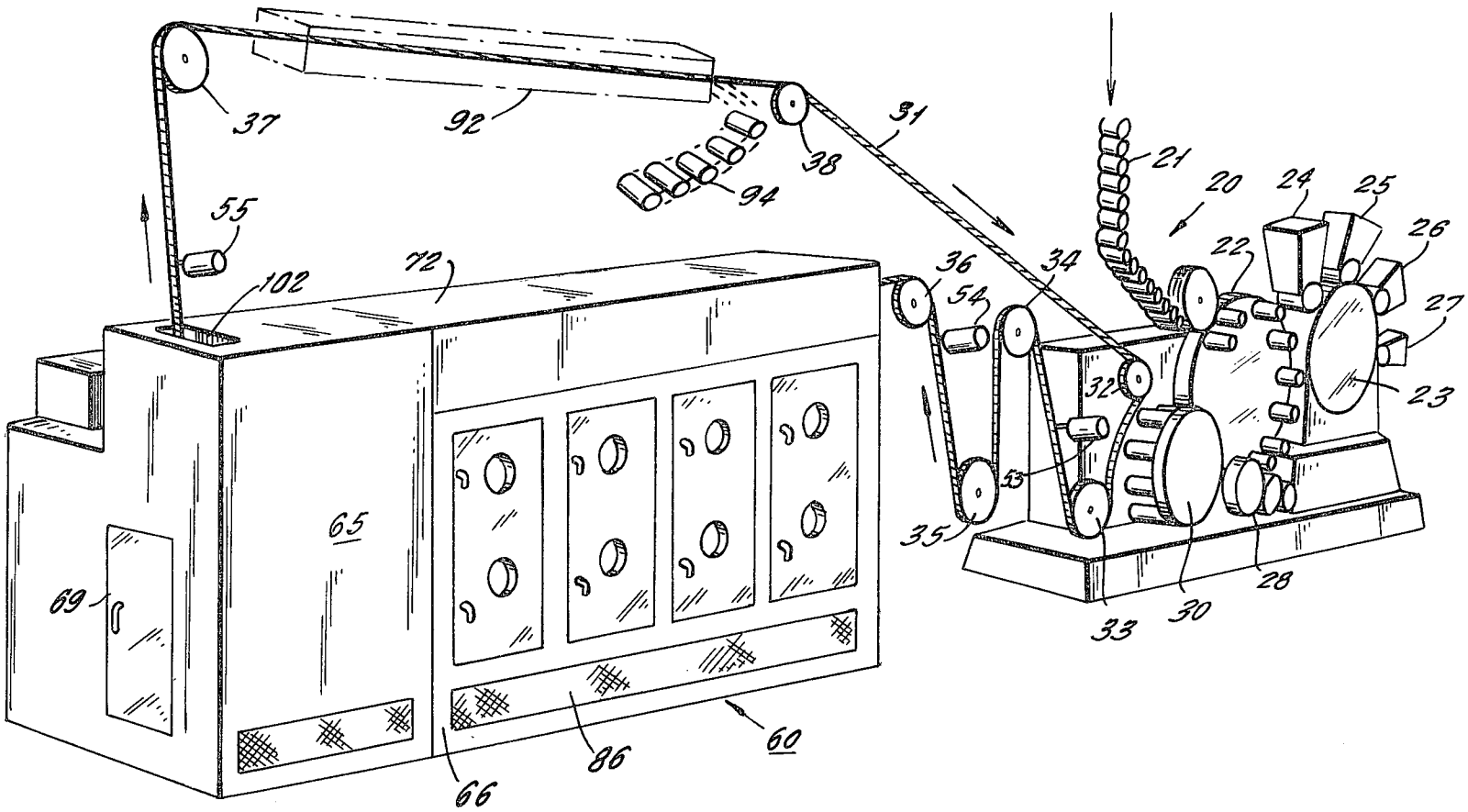
FIG. 1 is a perspective of a can decorating system including a curing section constructed in accordance with teachings of the instant invention.

Referring first to FIG. 1, there is shown can decorator 20 typically of the type shown in U.S. Pat. No. 3,766,851, which can place heat setting coatings, printing and/or overvarnish, herein termed a decorating medium, on cylindrical objects such as cans. Decorator 20 includes undecorated can infeed conveyor 21, rotating can support mechanism 22 which moves the cans along a path to contact printing blanket 23 associated with inkers 24, 25, 26 and 27, and overvarnish stage 28. Details of the construction of the decorator are found in U.S. Pat. No. 3,766,851.

After the cans have been decorated, they move into transfer section 30 where the decorated cans are loaded on conveyor pin chain 31. The latter is formed as a closed loop and carries pins spaced from one another along the length of chain 31. These pins extend generally perpendicularly from the plane in which chain 31 moves, and extend toward the open ends of the decorated cans on transfer mechanism 30. The cans are deposited by transfer section 30 on the pins of the chain 31 and are conveyed away from decorator 20.

Figure 2:
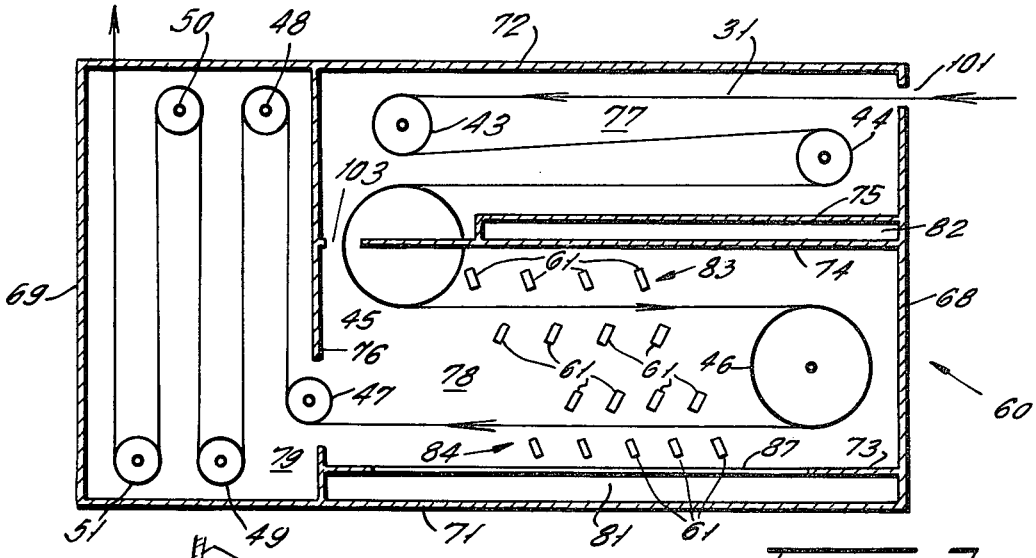
FIG. 2 is a schematic showing the can flow path through the preheat, curing and cooling chambers.
Figure 3:
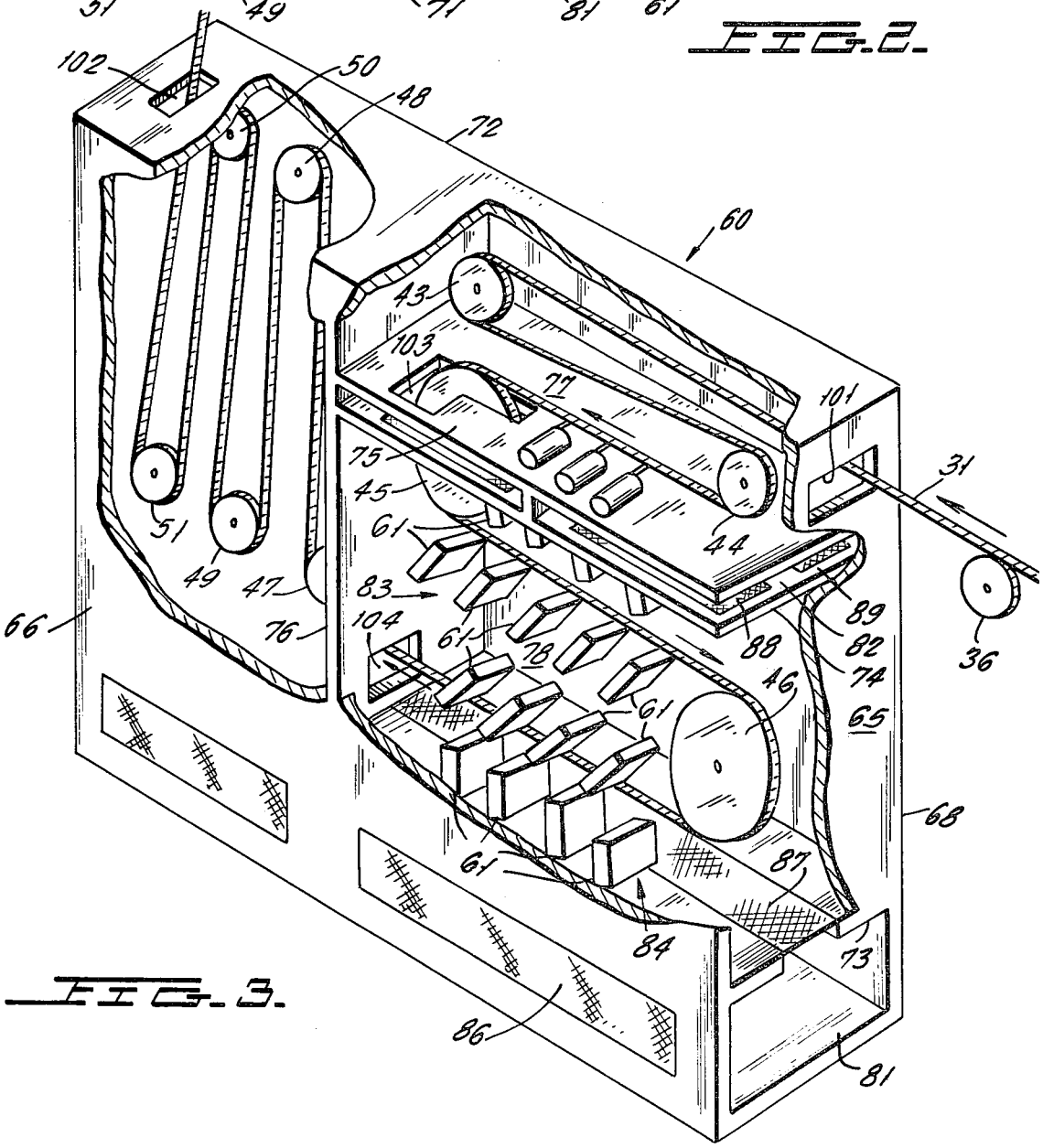
FIG. 3 is a perspective of the curing section housing with portions cut away to reveal the relationship between the main internal chambers.

Conveyor chain 31 is guided in its closed loop path by sprockets 32 through 38 seen in FIG. 1, and by other sprockets 43 through 51 (FIG. 3) within housing 65 of curing section 60. The path taken by chain 31 through curing section 60 is schematically shown in FIG. 2. Many of the chain-guiding sprockets may be suitably supported by the can plant structure and can vary with each installation. Steel support beams (not shown) are positioned so that chain 31 and sprockets 32 through 38 are in a plane which is tilted from the vertical by approximately 10°. Note in FIG. 1 that chain 31 is festooned between sprockets 33 through 36 to increase the time for the coating or varnish material to flow evenly over its respective area on the can before curing of the coating or varnish. These sprockets may be adjustably positioned to control the tension of chain 31.

Cans, such as cans 53 through 55 (FIG. 1) have been deposited on the pins of chain 31 by the transfer device 30. These pins extending perpendicularly from the plane of the chain, and are spaced from one another by about five inches, so that a continuous row of cans can be deposited on adjacent respective pins at up to 800 or more cans per minute, with the conveyor chain moving at speeds up to and greater than about 350 feet per minute.

The wet cans on chain 31 are first conveyed into an air-gas fired flame curing section 60 containing a plurality of spaced burners 61 each projecting an open flame jet toward the path taken by the cans through curing section 60. Section 60 may be from about ten to twenty-four feet long by about nine feet high and about eight feet deep. When cans leave the curing section 60, they are completely dried and cooled, and are discharged into can transfer mechanism 92 which removes decorated cans from pin chain 31 and directs them to can conveyor 94 which brings the cans to storage or to further processing locations.

Housing 65 is a generally rectangular structure including sidewalls 66, 67 connected along two opposite edges by end walls 68, 69, and along the other two edges by respective bottom and top walls 71, 72. Interior partitions 73 through 76 divide housing 65 into preheat chamber 77, curing or drying chamber 78, cooling chamber 79, fresh air plenum 81, and hot air plenum 82. The plurality of burners 61 are disposed within drying chamber 78 and are arranged in two zones or banks 83, 84, one above the other. Each of the banks 83, 84 consist of eight burners 61, four of which are arranged above the can path flight extending through the particular bank 83, 84 and the other four burners 61 of each bank being positioned below the path flight of this bank.

Figure 5:
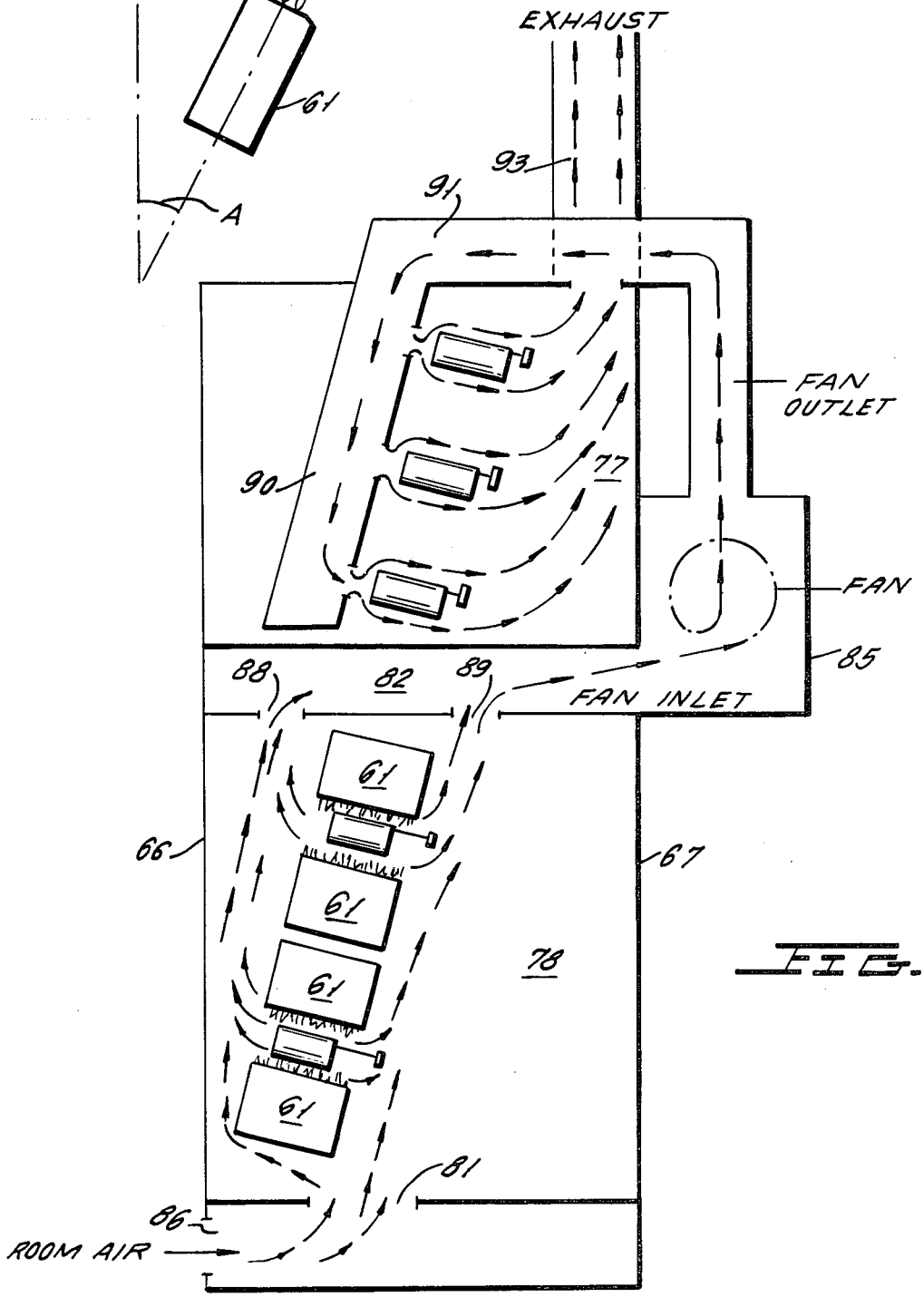
FIG. 5 is a transverse cross-section, in schematic form, of the curing section showing air flow through the preheat and drying chambers.

As seen in FIG. 5, fan 85 is disposed adjacent to housing wall 67 and is arranged to draw fresh air through screened inlet 86 of plenum 81, through screened outlet 87 of plenum 81, upward through drying chamber 78 into warm air plenum 82 through screened openings 88, 89 to the inlet of fan 85. The outlet of fan 85 is directed through conduit 91 to distribution manifold 90. Warm air supplied by manifold 90 passes generally sideways through preheat chamber 77 and exits through exhaust stack 93. A blower (not shown) is provided to circulate cool air through cooling chamber 79.

In operation, each can carried by pin chain 31 enters housing 65 through rectangular aperture 101 in end wall 68 and exits through rectangular aperture 102 in top wall 72 at the end thereof adjacent to the other end wall 69. As cans move through preheat chamber 77 they are heated, say to 350° F., and then passed downward through aperture 103 in partition 75 into drying chamber 78. As the preheated cans pass through the burner banks 83, 84 flame jets issuing from burners 61 impinge directly on the outsides of the cans to completely dry or cure the decorating medium on the outside of the cans. These cans then leave heating chamber 78 through aperture 104 in partition 76 and enter cooling chamber 79 wherein chain 31 is festooned so as to provide sufficient travel time within chamber 79 to assure that can temperature will be lowered to a satisfactory level by the time the cans move through exit aperture 102.

Figure 4:
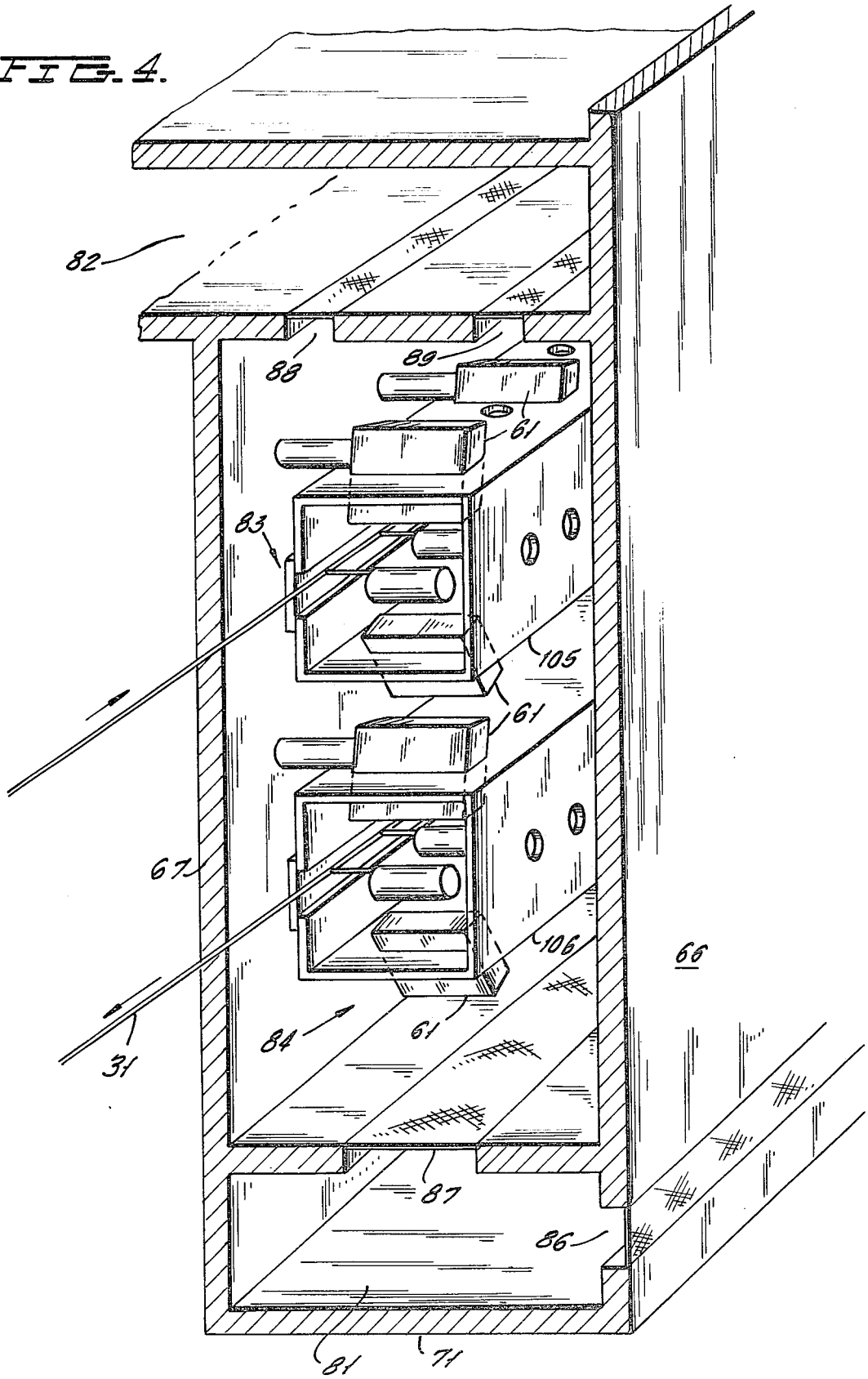
FIG. 4 is a fragmentary perspective of the drying chamber showing the inner tunnels which were omitted from FIG. 3 for the sake of clarity.

As seen in FIG. 4, the cans in zone 83 move through horizontal tunnel 105 and the cans in zone 84 move through horizontal tunnel 106. Each of the tunnels 105, 106 is of generally rectangular cross-section and is constructed of insulating material. Utilization of insulated tunnels 105, 106 concentrates heat generated by burner 61 along the can path. In addition, utilization of tunnels 105, 106 prevents undesirable cooling effects from air utilized to ventilate curing section 60. The two zone burner configuration with a substantial interruption in direct flame drying between zones 83, 84 has been found to beneficial in that the curing or drying process may be accomplished with less energy than required when curing is done by continuous flame impingement on the cans. Further by arranging zones 83, 84 one above the other, rather than end to end, the exterior radiating surfaces of housing 65 are of reduced area thereby improving heating efficiency.

Figure 6:
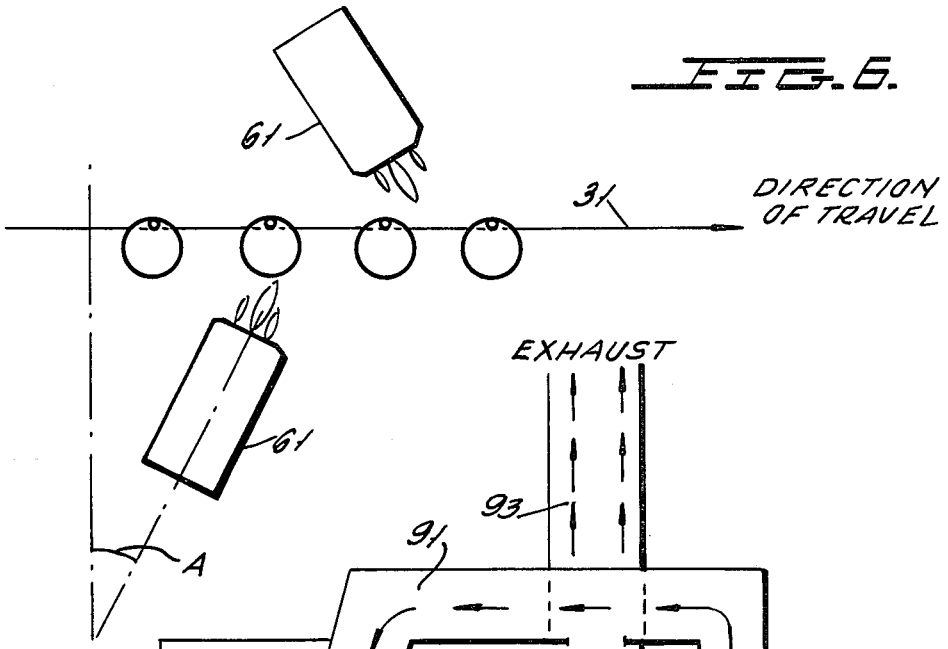
FIG. 6 is an enlarged schematic showing the downstream directed flame jets.

As seen best in FIG. 6, burners 61 are arranged so that the flame jets issuing therefrom are directed slightly downstream. This jet inclination, indicated by angle A, is preferably approximately 13° with respect to a line normal to the flight section toward which the flame jet is directed. However, burners 61 may be adjustably mounted so that angle A may be adjusted in the range of from 0°–45° downstream. Utilization of inclined flame jets serves to distribute the drying effect more evenly around the cans especially when the cans are not rotated. In addition, the flame jets above the flight section are in staggered relationship with respect to the flame jets below the flight section.

Fuel is also conserved by utilizing the exhaust from heating chamber 78 for raising the temperature of preheating chamber 77. Utilization of preheating zone 77 results in increasing permissible heating of the cans in drying zone 78. This serves to prevent the flow of tin in the heated cans as a result of slight changes in temperature and heating times.

Although a preferred embodiment of this invention has been described, many variations and modifications will now be apparent to those skilled in the art, and it is therefore preferred that the instant invention be limited not by the specific disclosure herein but only by the appending claims.

What is claimed is:

1. A direct flame system for curing a decorating medium applied to the outer surface of cylindrical objects, said system including chamber defining first means, conveyor means for carrying cylindrical objects along a predetermined path through said first means, burner means in a drying chamber portion of said first means, said burner means emitting flame jets which impinge directly upon cylindrical objects at a first section of said path located in said drying chamber, said first means including another portion defining a preheat chamber disposed along said path upstream of said drying chamber, said preheat chamber being heated by heat exhausted from said drying chamber, said conveyor carrying cylindrical objects from said preheat chamber to said drying chamber solely along a section of said path surrounded by said first means, said drying chamber having an inlet and said preheat chamber having an outlet, fan means to draw air into said drying chamber through said inlet, circulate said air first through said drying chamber and then through said preheat chamber, and thereafter exhaust said air from said preheat chamber through said outlet.

2. A system as set forth in claim 1, in which the burner means includes first and second banks each containing a plurality of burners; said first bank being disposed upstream of said second bank; individual first and second insulating tunnel means disposed within said drying chamber and surrounding said first and second banks, respectively, said tunnel means being positioned so that a substantial portion of said first section of said path extends between the downstream end of the first tunnel means and the upstream end of the second tunnel means, said portion of said first section being clear of burner means.

3. A system as set forth in claim 1 in which the flame jets are directed downstream.

4. A system as set forth in claim 1 in which the flame jets are directed downstream at an angle of approximately 13° with respect to a line normal to said path from the tail of the flame jet in question.

5. A system as set forth in claim 1 in which the preheat chamber is disposed above the drying chamber and within the heating chamber the path is festooned to provide a plurality of generally horizontal runs.

6. A system as set forth in claim 5 in which the first means includes a further portion defining a cooling chamber disposed along said path downstream of said drying chamber; said cooling chamber being disposed at one end of said first means and said drying and preheat chambers being disposed at the other end of said first means; within said cooling chamber said path being festooned to provide a plurality of generally vertical runs.

7. A system as set forth in claim 6 in which the flame jets are directed downstream.

8. A system for curing a decorating medium applied to the outer surface of cylindrical objects, said system including chamber defining first means, conveyor means for carrying cylindrical objects along a predetermined path through said first means, heater means for producing heat in a drying chamber portion of said first means, said heater means producing sufficient heating energy to cure decorating medium on cylindrical objects at a first section of said path located in said drying chamber, said first means including another portion defining a preheat chamber disposed along said path upstream of said drying chamber, said preheat chamber being heated by heat exhausted from said drying chamber, said heater means including first and second banks each containing a plurality of burners, said first bank being disposed upstream of said second bank, said first and second banks being disposed along first and second parts of said path, said parts being generally parallel to and offset from each other, said first section of said path also including a connecting part of substantial length interconnecting said first and second parts, said connecting part being clear of heater means.

9. A system as set forth in claim 8 also including insulating tunnel means disposed within said drying chamber and surrounding said first and second banks.

* * * * *